US011059067B1

(12) United States Patent
Afshin

(10) Patent No.: US 11,059,067 B1
(45) Date of Patent: Jul. 13, 2021

(54) SPRINKLER HEAD REPLACEMENT ASSEMBLY

(71) Applicant: S. Alex Afshin, Southlake, TX (US)

(72) Inventor: S. Alex Afshin, Southlake, TX (US)

( * ) Notice: Subject to any disclaimer, the term of this patent is extended or adjusted under 35 U.S.C. 154(b) by 0 days.

(21) Appl. No.: 16/433,423

(22) Filed: Jun. 6, 2019

(51) Int. Cl.
*B05B 15/622* (2018.01)
*B05B 15/70* (2018.01)

(52) U.S. Cl.
CPC ..... *B05B 15/622* (2018.02); *B05B 15/70* (2018.02)

(58) Field of Classification Search
CPC ..... B06B 15/622; B05B 15/70; B05B 15/628; B05B 15/62; B05B 15/625; F16L 3/1207; F16L 3/12; F16L 3/1211; F16L 3/1218; F16L 3/1222; E04H 12/2238; E04H 12/2276
See application file for complete search history.

(56) References Cited

U.S. PATENT DOCUMENTS

| | | | | |
|---|---|---|---|---|
| 4,436,272 | A * | 3/1984 | Lile | A47G 33/12 248/527 |
| 4,788,894 | A | 12/1988 | Mitschele | |
| 5,996,612 | A * | 12/1999 | Crawford | E02D 29/1409 137/364 |
| 6,648,241 | B1 | 11/2003 | Doshay | |
| 6,712,086 | B1 * | 3/2004 | Fails | E03B 7/072 137/15.03 |
| 6,732,946 | B2 | 5/2004 | Veazie | |
| 6,796,013 | B2 | 9/2004 | Melker et al. | |
| 6,871,795 | B2 | 3/2005 | Anuskiewicz | |
| 9,415,470 | B2 | 8/2016 | Curry et al. | |
| D809,883 | S | 2/2018 | Trudeau | |
| 2008/0087742 | A1 * | 4/2008 | Cheng | E01H 3/04 239/202 |
| 2017/0095826 | A1 * | 4/2017 | Schneider | B05B 15/70 |

* cited by examiner

*Primary Examiner* — Tuongminh N Pham
(74) *Attorney, Agent, or Firm* — Cramer Patent & Design, PLLC; Aaron R. Cramer

(57) ABSTRACT

An assembly for replacing sprinkler heads includes a sprinkler head housing assembly with a cap, a sprinkler head, a sprinkler head support assembly core, a plurality of spacers, and a base. The sprinkler head housing assembly enables replacement of a damaged inground sprinkler head.

5 Claims, 7 Drawing Sheets

SPRINKLER HEAD REPLACEMENT ASSEMBLY

FIELD OF THE INVENTION

The present invention relates in general to a sprinkler head replacement assembly and specifically to inground sprinkler head assemblies.

BACKGROUND OF THE INVENTION

Many Americans spend countless hours maintaining and beautifying their lawns and landscape. As a matter of pride and personal expression, these people manicure their grass, plant and maintain flowers, shrubs, bushes and trees all for the sake of enhancing the aesthetic qualities of their property. One of the most common, but most important duties associated with good looking landscaping is that of proper watering. Those of us who use underground sprinkler systems are aware of how pop-up spray heads provide coverage for large areas of lawns and gardens.

However, one aspect associated with the use of an underground system is that of periodic sprinkler head replacement. This task requires the surrounding dirt area to be dug up which occupies most of the total replacement time, and labor costs should the job be contracted out. Accordingly, there exists a need for a means by which underground irrigation sprinkler heads can be easily replaced without the necessity of digging up the head. The development of the sprinkler head replacement assembly fulfills this need.

SUMMARY OF THE INVENTION

In view of the foregoing references, the inventor recognized the aforementioned inherent problems and observed that there is a need for an underground sprinkler head access housing, comprises a base having a flange and a plurality of stiffening members, a plurality of spacers which are placed above the base and at least one access hole which provides for an entrance of a sprinkler lateral. The sprinkler lateral enters and exits the housing through the at least one access hole in the base above the flange. The sprinkler lateral is interconnected at a tee fitting with a riser pipe extended upward and terminating at a pop-up sprinkler head. The pop-up sprinkler head is affixed at the center axis of the housing and is held in position by a plurality of support arms. Each of the support arms include a stationary support, a movable support, an adjustment mechanism and a holding jaw.

The underground sprinkler head access housing also comprises a sprinkler head support assembly which provides vertical stabilization for an enclosed sprinkler head. The sprinkler head support assembly is located above an uppermost spacer. The underground sprinkler head access housing also comprises a cap having an uppermost surface of the underground sprinkler head access housing which is exposed to view once fully installed and a flapper assembly which is located at a center of the cap to allow access for an activated pop-up sprinkler head.

The spacers may be added such that the cap and the flapper assembly are slightly above grade. The pair of spacers may be cylindrical in shape. The underground sprinkler head access housing may also further comprise a plurality of additional access holes which are provided at one-hundred-eighty degrees. At least one access hole may allow for installation and subsequent use of the underground sprinkler head access housing in existing sprinkler installations as part of a retrofit process.

The movable support may be inserted into the stationary support and may move in and out along a travel path which forces the holding jaw against the pop-up sprinkler head. The movement may be accomplished by the adjustment mechanism acting upon a threaded surface. The adjustment mechanism may be an adjustment knob to place the holding jaw in a disengaged position. The adjustment knob may be manipulated to place the holding jaw in an engaged position as part of an installation process. A lower convex surface of the sprinkler head support assembly may mate with a concave surface of one of the spacers. The lower convex surface of the sprinkler head support assembly may also mate with the concave surface of the base. The lower convex surface of one of the spacers may mate with the concave surface of another one of the spacers. The lower convex surface of one of the spacers may mate with the concave surface of the base while the cap may be provided with an anti-slip surface for increased safety. The cap may be provided with a twist-lock engagement mechanism which engages the cap to the sprinkler head support assembly. The pop-up sprinkler head may be removed by rotating it along a removal travel path to the pop-up sprinkler head for either maintenance, repair, or replacement and the pop-up sprinkler head may be reapplied by rotating it along an installation travel path.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
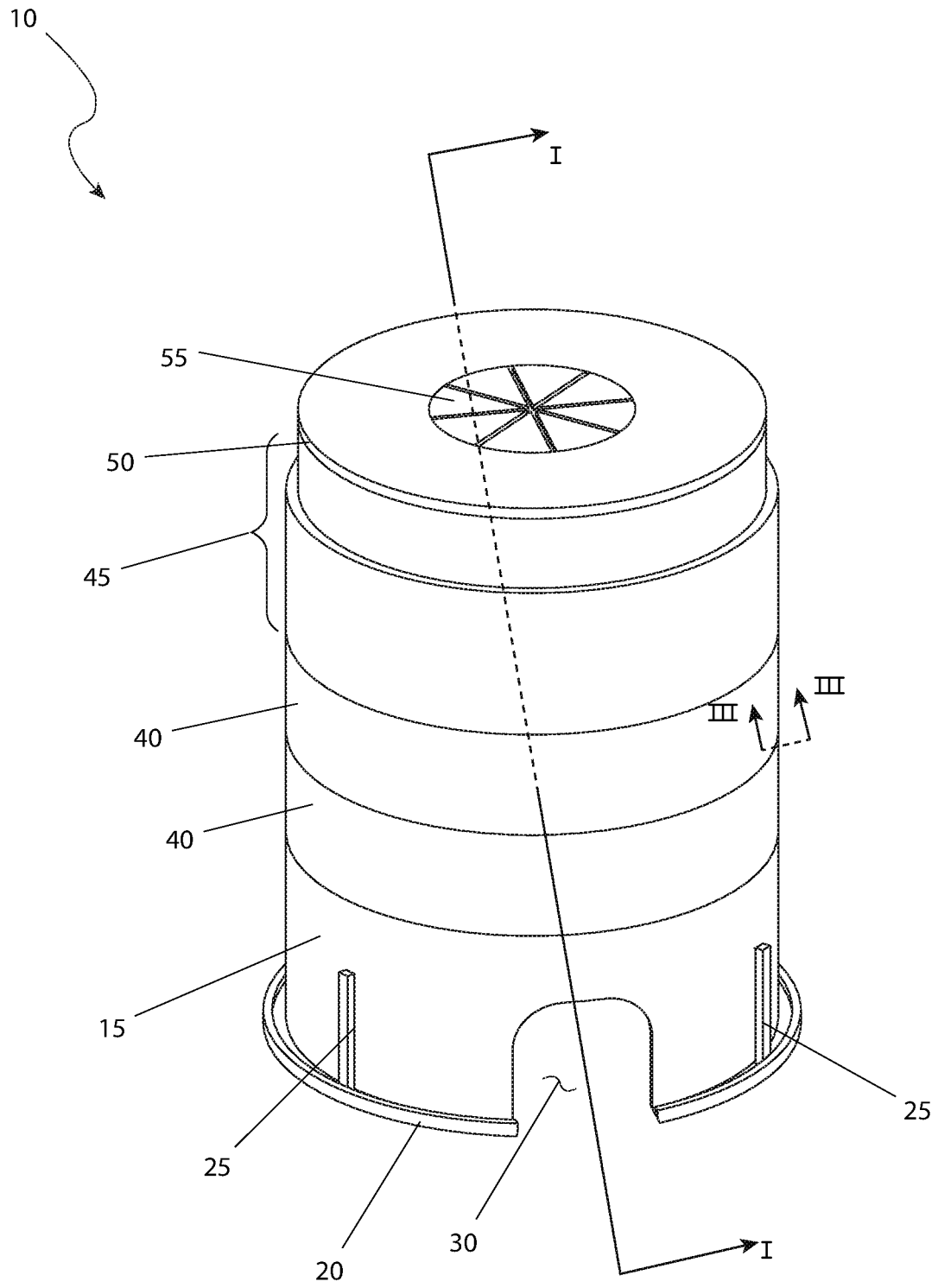
FIG. 1 is a perspective view of the underground sprinkler head access housing 10, according to the preferred embodiment of the present invention.

10 underground sprinkler head access housing
15 base
20 flange
25 stiffening member
30 access hole
35 sprinkler lateral
40 spacer
45 sprinkler head support assembly
50 cap
55 flapper assembly
60 tee fitting
65 riser pipe
70 pop-up sprinkler head
75 grade
80 vegetation
85 support arm
90 stationary support
95 movable support
100 adjustment mechanism
105 holding jaw
110 travel path "a"
115 adjustment knob
120 threaded surface
125 disengaged position
130 engaged position
135 sidewall surface
140 convex surface
145 concave surface
150 anti-slip surface
155 twist-lock engagement mechanism
160 removal travel path "r"
165 installation travel path "i"
170 flexible triangular-shaped element
175 water
180 folded state

DESCRIPTION OF THE PREFERRED EMBODIMENTS

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the underground sprinkler head access housing 10, according to the preferred embodiment of the present invention is disclosed. The underground sprinkler head access housing 10 (herein also described as the "housing") 10, is a generally cylindrical assembly with an open end on the bottom and a closed end on top, that houses an underground pop up sprinkler head to facilitate ease access for maintenance, repair or replacement. All components of the housing 10 would be made from various forms of rigid or flexible plastic/rubber compounds that are resistant to water, underground exposure, ultraviolet radiation, insects, rodents, and the like. The exact material of construction used in the various components of the housing 10 is not intended to be a limiting factor of the present invention. The housing 10 is built up from various components to suit the particular installation specifics.

The housing 10 includes a base 15 with a lower flange 20 and stiffening members 25. At least one (1) access hole 30 is provided for entrance of a sprinkler lateral 35 (not shown in this figure). Additional access holes 30 (not shown) may be provided at one-hundred-eighty degrees (180°) and/or at +/− ninety degrees (90°) from the access hole 30 as shown. Further detail on the entrance/exit of the sprinkler lateral 35 will be shown herein below. Located immediately above the base 15 are two (2) spacers 40 which are cylindrical in shape. The housing 10 may utilize zero (0), one (1), two (2) (as shown), three (3) or more spacers 40 depending on the exact parameters of each specific installation. It is noted that the spacers 40 may be of differing overall heights as well, allowing the installer to vary the overall height of the housing 10 to the exact needed dimension. The specific overall height would be controlled by the depth of which the sprinkler lateral 35 is buried below grade, and as such, the overall final height of the housing 10 is not intended to be a limiting factor of the present invention. Located above the uppermost spacers 40 is a sprinkler head support assembly 45 which provides vertical stabilization for the enclosed sprinkler head (not shown) which will be described in greater detail herein below. A cap 50 comprises the uppermost surface of the housing 10 and is exposed to view once fully installed. A flapper assembly 55 is located at the center of the cap 50 to allow access for an activated pop-up sprinkler head (not shown).

Figure 2:
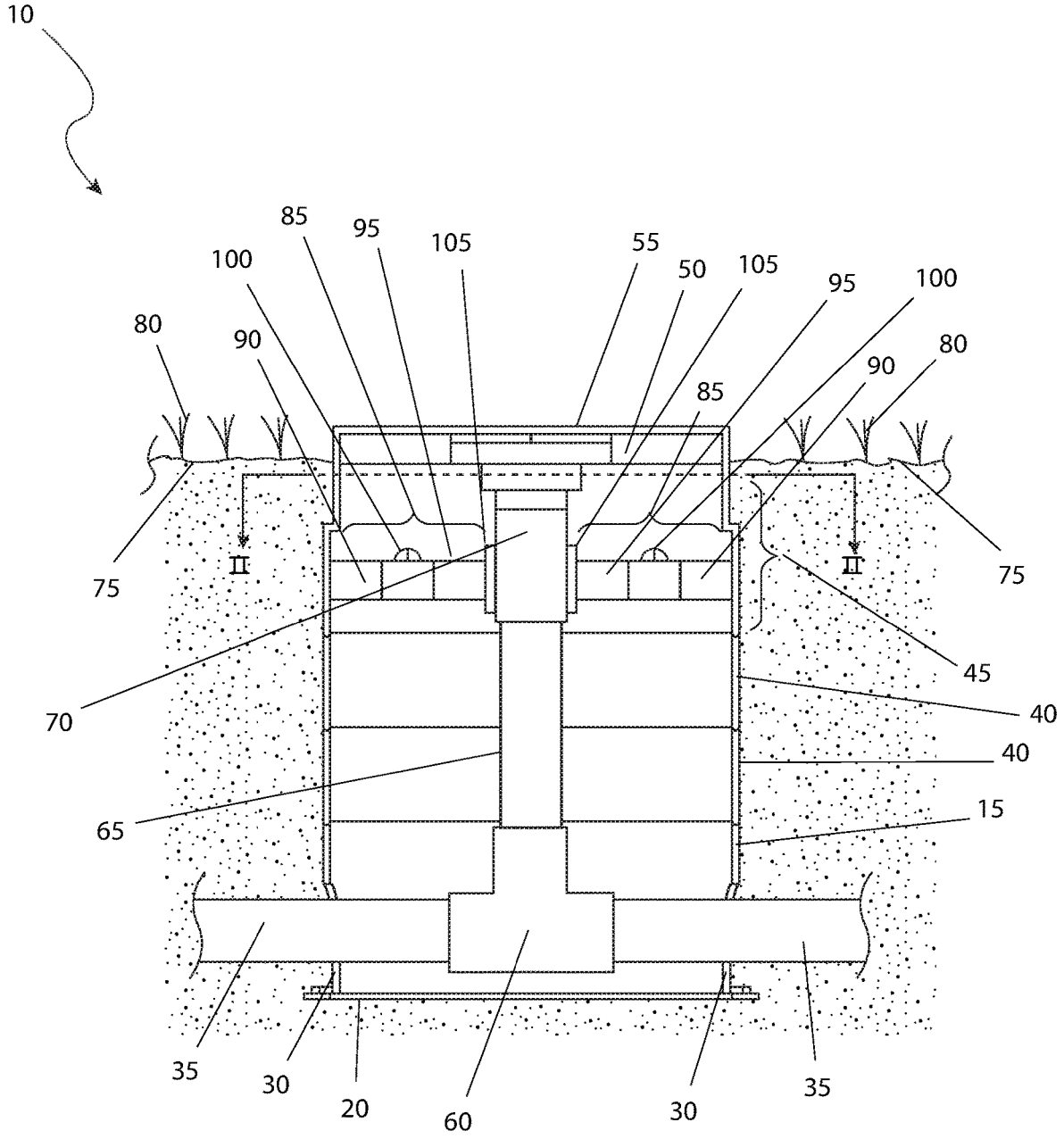
FIG. 2 is a sectional view of the underground sprinkler head access housing 10, shown in an installed state, as seen along a line I-I, as shown in FIG. 1, according to the preferred embodiment of the present invention.

Referring next to FIG. 2. a sectional view of the housing 10, shown in an installed state, as seen along a line I-I, as shown in FIG. 1, according to the preferred embodiment of the present invention is depicted. The sprinkler lateral 35 enters and exits the housing 10 through access hole 30 in the base 15 above the flange 20. It is noted that the open nature of the access hole 30 (as shown in FIG. 1) allows for installation and subsequent use of the housing 10 in existing sprinkler installations as part of a retrofit process. The sprinkler lateral 35 is interconnected at a tee fitting 60 with a riser pipe 65 extended upward and terminating at a pop-up sprinkler head 70. As aforementioned described, additional sections of spacers 40 are added such that the cap 50 and flapper assembly 55 are slightly above grade 75 but perhaps slightly below vegetation 80 such as turf. The pop-up sprinkler head 70 is affixed at the center axis of the housing 10 and is held in position by four (4) support arms 85 of which only two (2) are shown due to illustrative limitations. Each support arms 85 is comprised of a stationary support 90, a movable support 95, an adjustment mechanism 100 and a holding jaw 105. The support arms 85 will be described in greater detail herein below.

Figure 3:
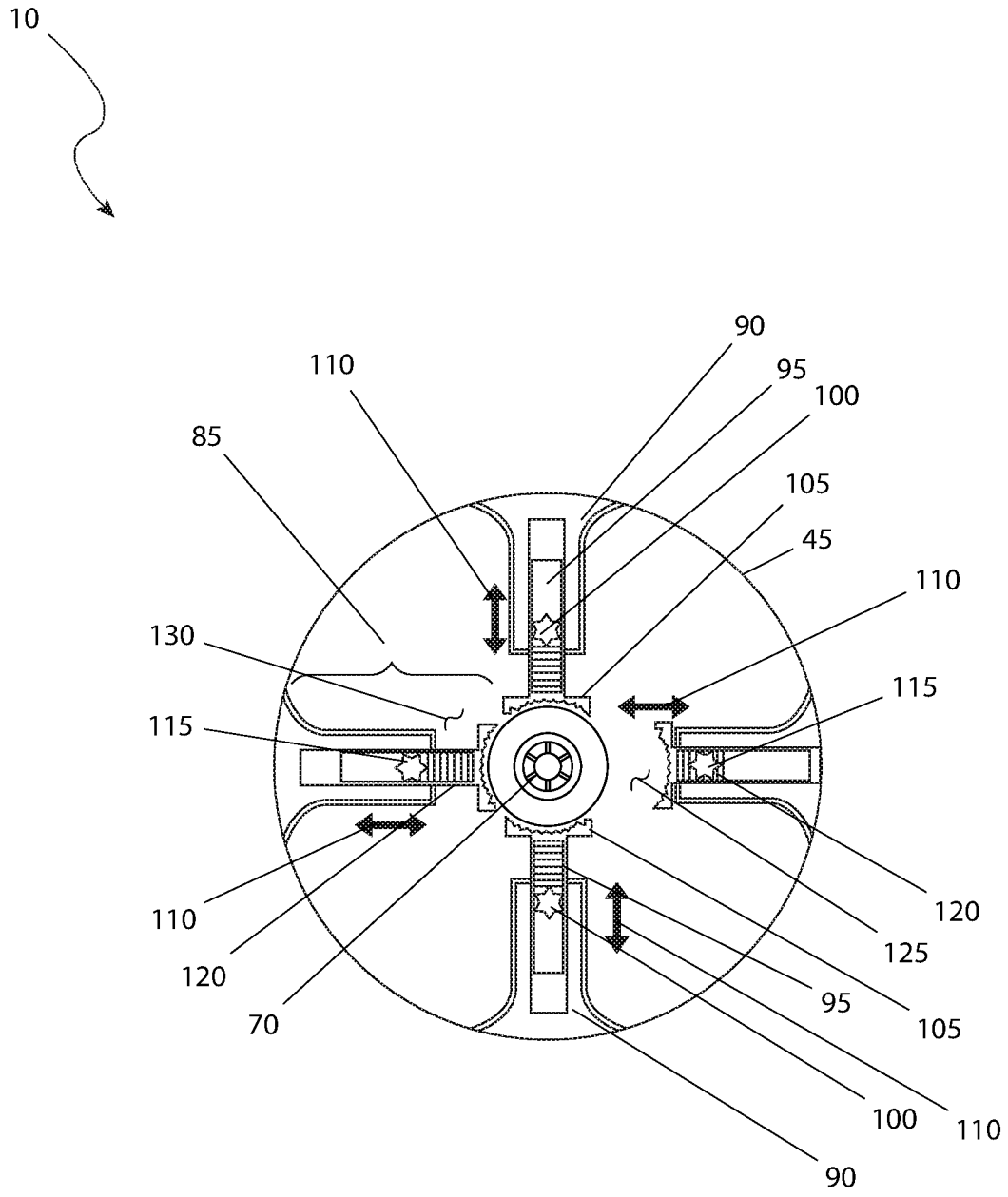
FIG. 3 is a sectional view of the underground sprinkler head access housing 10, as seen along a line II-II, as shown in FIG. 2, according to the preferred embodiment of the present invention.

Referring now to FIG. 3, a sectional view of the housing 10, as seen along a line II-II, as shown in FIG. 2, according to the preferred embodiment of the present invention is shown. This view discloses the four (4) support arms 85 that keep the pop-up sprinkler head 70 in a centered position within the sprinkler head support assembly 45. The stationary support 90 may be molded as an integral part of the sprinkler head support assembly 45. The movable support 95 is inserted into the stationary support 90 and moves in and out along a travel path "a" 110 which forces the holding jaw 105 against the pop-up sprinkler head 70. This movement is accomplished by the adjustment mechanism 100 consisting of an adjustment knob 115 acting upon a threaded surface 120. It is noted that prior to installation, all adjustment knob 115 are manipulated to place the holding jaw 105 in a disengaged position 125. As part of the installation process, all adjustment knob 115 are then manipulated to place all movable support 95 as well as the associated holding jaw 105 in an engaged position 130.

Figure 4:
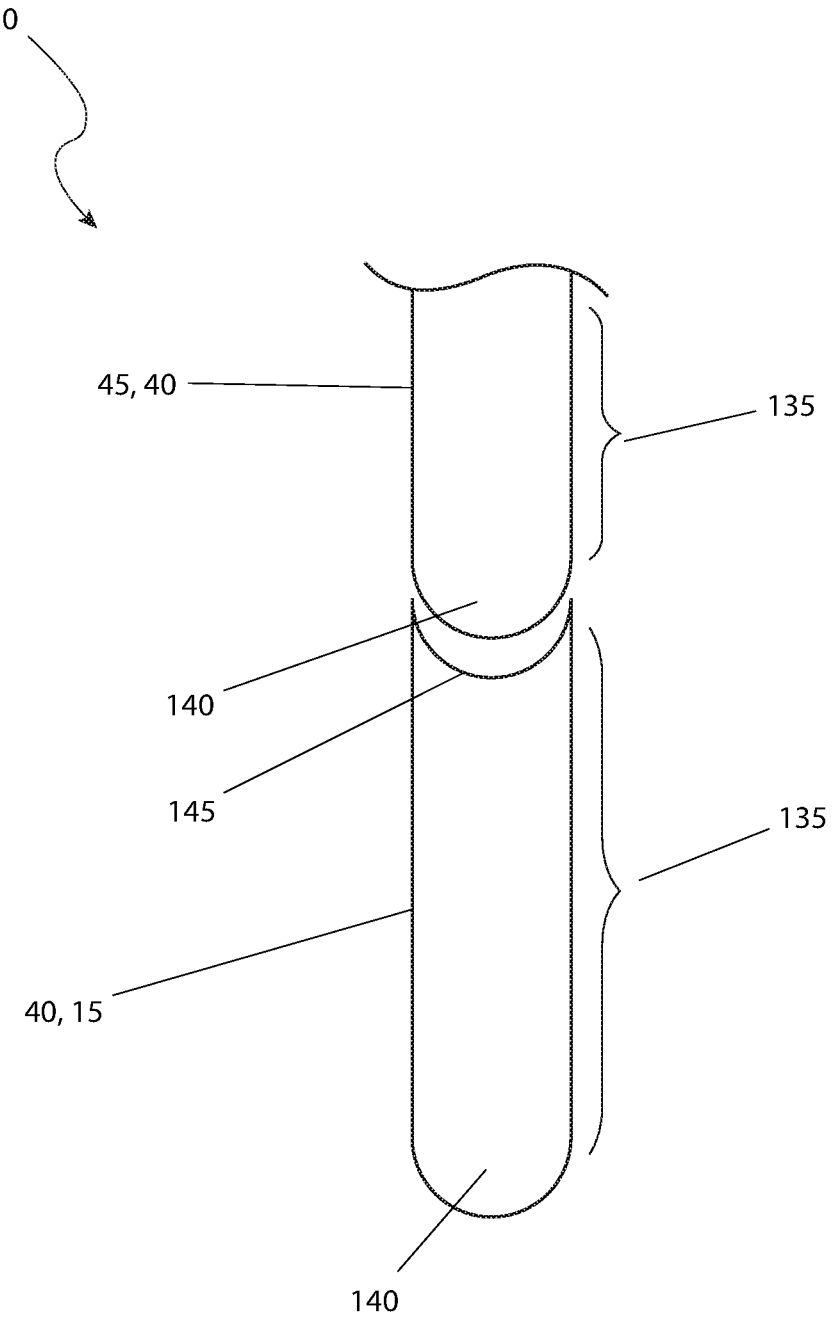
FIG. 4 is a detailed sectional view of the underground sprinkler head access housing 10, as seen along a line III-III, as shown in FIG. 1, according to the preferred embodiment of the present invention.

Referring next to FIG. 4, a detailed sectional view of the housing 10, as seen along a line III-III, as shown in FIG. 1, according to the preferred embodiment of the present invention is disclosed. This view discloses a sidewall surface 135 of either the spacers 40, the sprinkler head support assembly 45, and/or the base 15, depending on the junction noted. A lower convex surface 140 of either the sprinkler head support assembly 45 or the spacers 40 will mate with a concave surface 145 of either another spacers 40 or the base 15. This junction is envisioned to be self-aligning and moisture proof. Other methods of joining such as threaded surfaces, interlocking tabs, pins, and the like could be used with equal effectiveness. As such, the specific method of joining the sprinkler head support assembly 45 or the spacers 40 to another spacer 40 or the base 15 should not be interpreted as a limiting factor of the present invention.

Figure 5:
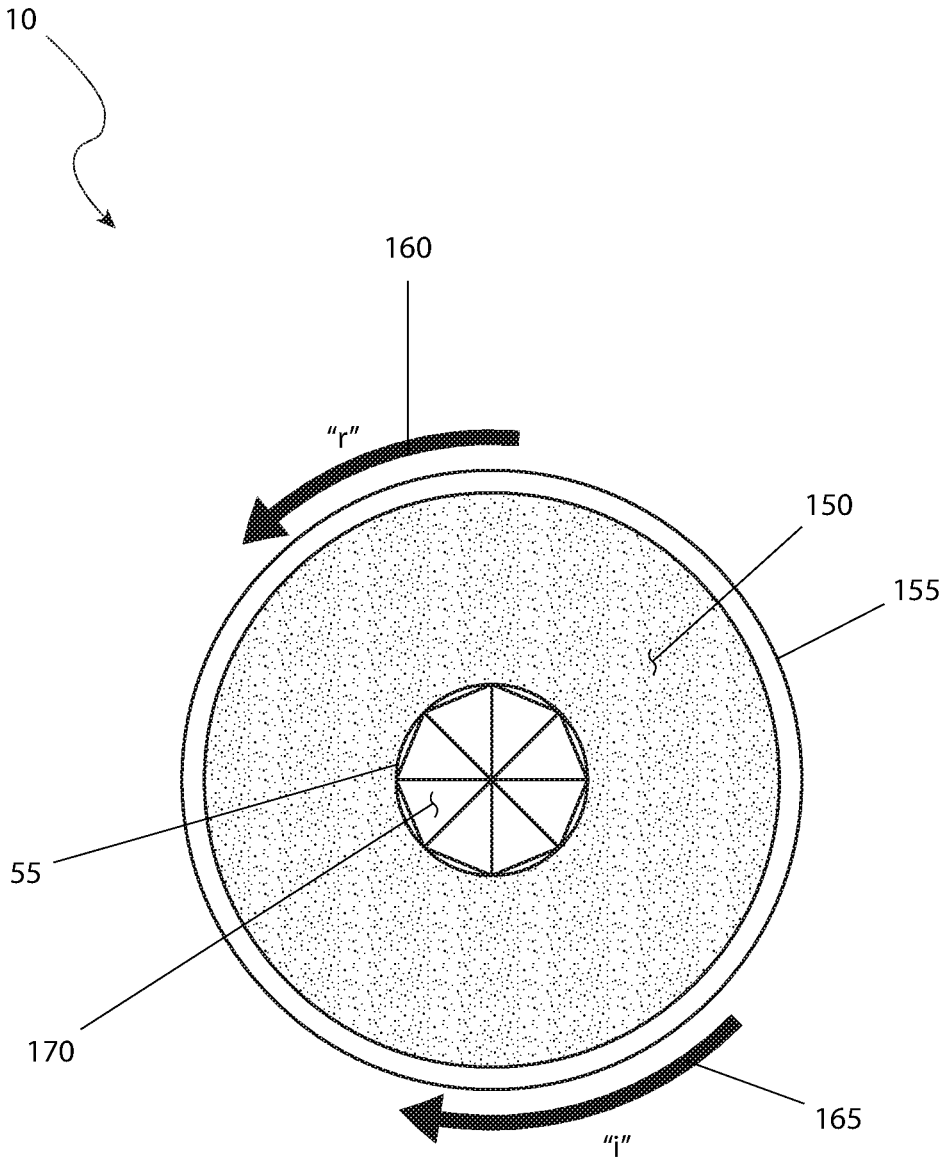
FIG. 5 is a top view of the underground sprinkler head access housing 10, shown in a retracted or unused state, according to the preferred embodiment of the present invention.

Referring now to FIG. 5, a top view of the housing 10, shown in a retracted or unused state, according to the preferred embodiment of the present invention is depicted. The cap 50 is provided with an anti-slip surface 150 for increased safety should someone walk across said cap 50. The cap 50 is provided with a twist-lock engagement mechanism 155 which engages the cap 50 to the sprinkler head support assembly 45 (as shown in FIG. 1 and FIG. 2). The twist-lock engagement mechanism 155 is well known in the art. Should access be needed to the pop-up sprinkler head 70 (as shown in FIG. 2) for either maintenance, repair, or replacement, the cap 50 is removed by rotating it along a removal travel path "r" 160. When access is no longer needed, it is reapplied by rotating it along an installation travel path "i" 165. The flapper assembly 55 preferably has at least eight (8) flexible triangular-shaped elements 170. In their normal or closed state as shown, the flexible triangular-shaped elements 170 are aligned along their outer edges to present a general barrier against the infiltration of dirt and debris, thus presenting an otherwise aesthetically pleasing appearance.

Figure 6:
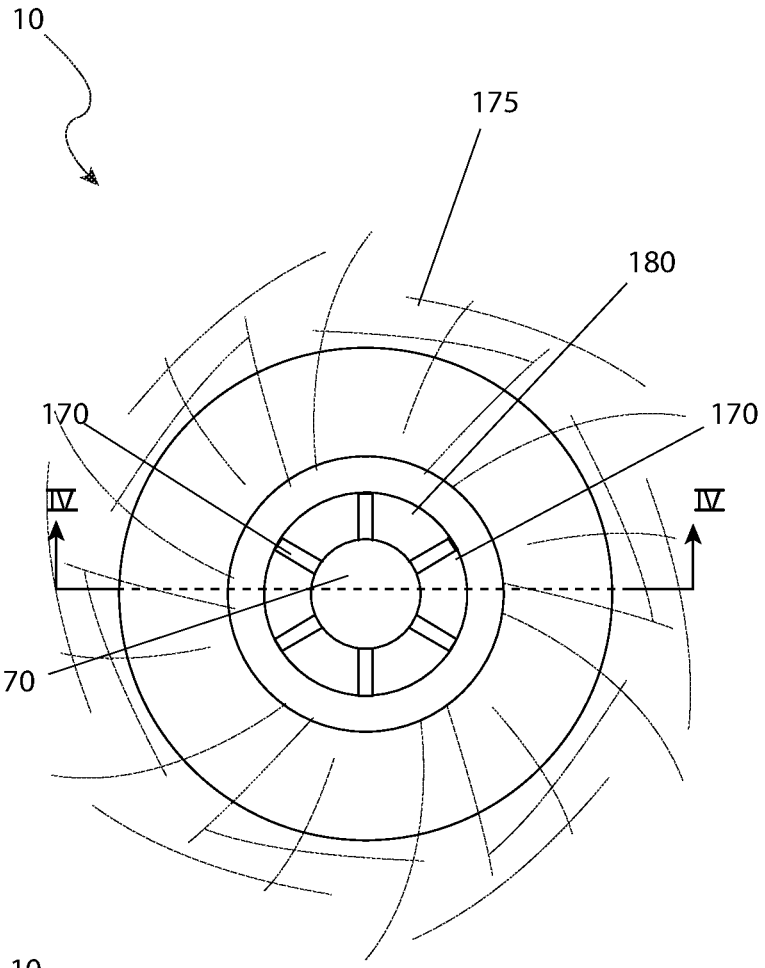
FIG. 6 is a top view of the underground sprinkler head access housing 10, shown in a used or deployed state, according to the preferred embodiment of the present invention; and, FIG. 7 is a sectional view of the cap 50 and pop-up sprinkler head 70, as shown along a line IV-IV as seen in FIG. 6, according to the preferred embodiment of the present invention; and, FIG. 8 is an isometric view of the support arm 85 assemblies as used with underground sprinkler head access housing 10, according to the preferred embodiment of the present invention.

Referring next to FIG. 6, a top view of the housing 10, shown in a used or deployed state, according to the preferred embodiment of the present invention is shown. This view discloses the vegetation 80 in an extended and operating state dispensing water 175 as is expected during its operating state. The flexible triangular-shaped elements 170 are flexed out of the way of the protruding pop-up sprinkler head 70 and remain in a folded state 180 as shown until the pop-up sprinkler head 70 withdraws into the housing 10 thus allowing the flexible triangular shaped elements 170 to retract as shown in FIG. 5.

Figure 7:
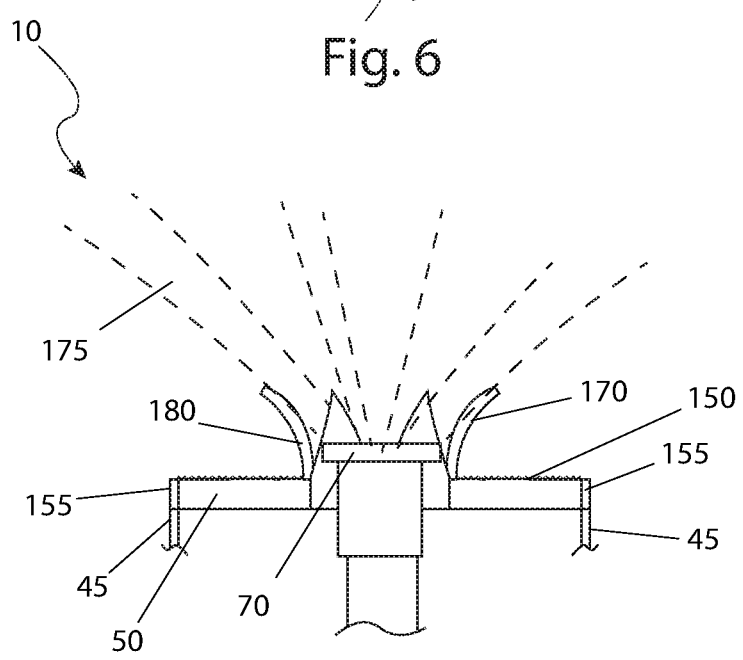

Referring to FIG. 7, a sectional view of the cap 50 and pop-up sprinkler head 70, as shown along a line IV-IV as seen in FIG. 6, according to the preferred embodiment of the present invention is disclosed. This view provides clarification on the pop-up sprinkler head 70 extending through the flexible triangular-shaped elements 170 placing them in a folded state 180 as the pop-up sprinkler head 70 dispenses water 175. The twist-lock engagement mechanism 155 can be seen in an engaged state joining the sprinkler head support assembly 45 to the cap 50. The anti-slip surface 150 presents a safe surface upon which to walk should the cap 50 be wet.

Figure 8:
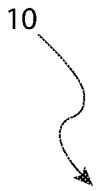
Figure 8:
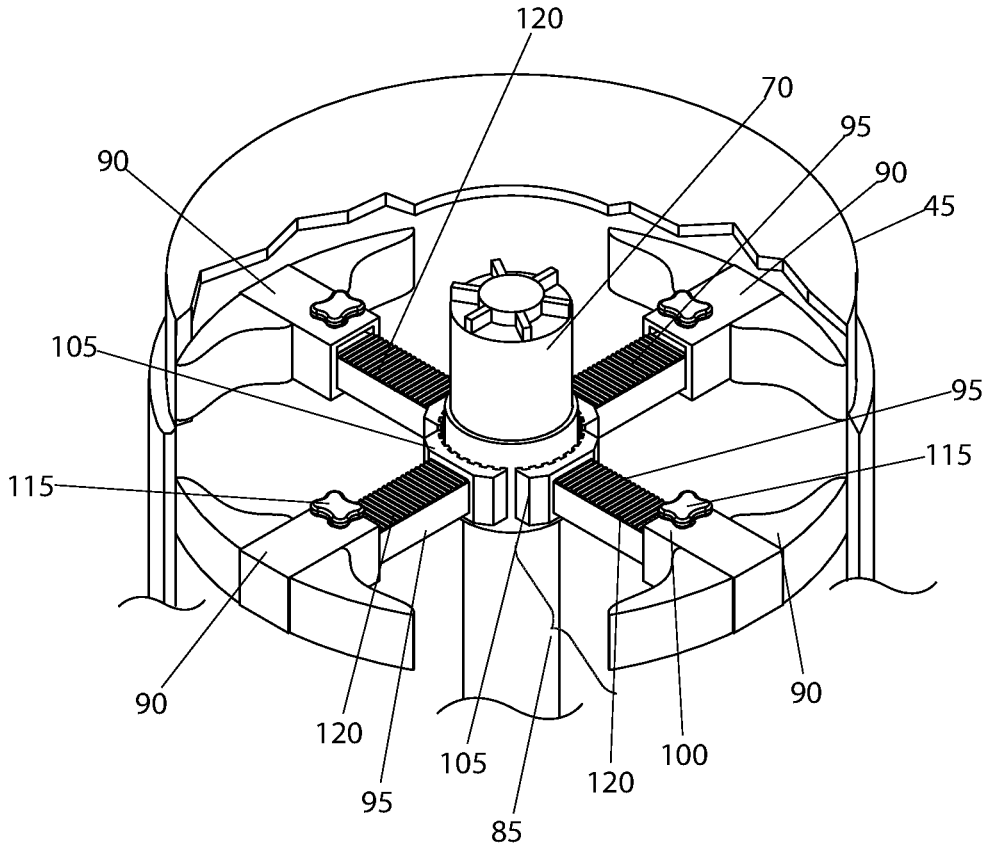

Referring to FIG. 8, an isometric view of the support arm 85 assemblies as used with underground sprinkler head access housing 10, according to the preferred embodiment of the present invention is depicted. This view discloses the four (4) support arms 85 that keep the pop-up sprinkler head 70 in a centered position within the sprinkler head support assembly 45. The stationary support 90 may be molded as an integral part of the sprinkler head support assembly 45. The movable support 95 is inserted into the stationary support 90 at one end and attached to the holding jaw 105 at the opposite end. The holding jaw 105 engages the pop-up sprinkler head 70 by manipulation of the adjustment knob 115 acting upon a threaded surface 120.

2. Operation of the Preferred Embodiment

The preferred embodiment of the present invention can be utilized by the common user in a simple and effortless manner with little or no training. It is envisioned that the housing 10 would be constructed in general accordance with FIG. 1 through FIG. 8. The user would procure the housing 10 from conventional procurement channels such as home and garden store, a hardware store, a plumbing supply house, an irrigation supply house or through a contractor.

The housing 10 could be installed as part of an original irrigation system install, installed as a complete retrofit where all pop-up sprinkler head 70 are equipped with the functionality of the housing 10, or as a one by one replacement, where existing pop-up sprinkler head 70 are equipped with the functionality of the housing 10 as they sequentially fail such that all pop-up sprinkler head 70 would be equipped with a housing 10 over a period of time.

After procurement and prior to utilization, the housing 10 would be prepared in the following manner: a suitable excavation in the grade 75 would be provided to accept the outer diameter of the housing 10 and expose the sprinkler lateral 35; the pop-up sprinkler head 70 would be connected to the sprinkler lateral 35 through the use of the tee fitting 60 and the riser pipe 65 if needed using conventional connection methods not within the scope of the present invention; the base 15 would be centrally located over the pop-up sprinkler head 70 with the sprinkler lateral 35 running through the access hole 30 as necessary; if necessary, sections of spacers 40 would be added in the correct quantity and size such that the finished assemble is slightly above grade 75 and slightly below the top of the adjacent vegetation 80; adjust the four (4) support arms 85 by manipulation of the adjustment mechanism 100 and adjustment knob 115 to engage the movable support 95 and the holding jaw 105 on the pop-up sprinkler head 70 to hold and secure the pop-up sprinkler head 70 in a central position; and place the cap 50 atop the sprinkler head support assembly 45 and engage it by rotation along the installation travel path "i" 165. At this point in time, the housing 10 along with the contained pop-up sprinkler head 70 is ready for use in a customary manner.

Should access to the pop-up sprinkler head 70 be needed for maintenance, repair or replacement, the following procedure would be initiated: the cap 50 would be removed via rotation along the removal travel path "r" 160; the pop-up sprinkler head 70 would be freed by manipulation of the adjustment mechanism 100 and adjustment knob 115 to disengage the movable support 95 and the holding jaw 105 from the pop-up sprinkler head 70. At this point in time, the pop-up sprinkler head 70 is completely free for any purposes needed. When maintenance is complete, or repair/replacement complete, the above installation procedure would be repeated to complete the repair process. This repair process is accomplished without any time consuming or costly excavation of grade 75 thus allowing maintenance, repair, or replacement to be accomplished in a short time.

During use of the housing 10, the pop-up sprinkler head 70 will automatically extend (pop-up) through the flapper assembly 55 to allow for the dispensing of water 175. Upon completion of the watering cycle, the pop-up sprinkler head 70 will retract downward and allow the flexible triangular shaped elements 170 to return to a flat state. Future watering cycles will repeat in a cyclical manner.

Said usage of the housing 10 will result in the following benefits: elimination of costly and time consuming excavation for maintenance, repair, or replacement of the pop-up sprinkler head 70, easy height adjustment to allow for accommodation of any buried depth of sprinkler lateral 35, protection of the sprinkler lateral 35, the tee fitting 60, the riser pipe 65 and the pop-up sprinkler head 70 from impact damage, contact with grade or the like, easy do-it-yourself replacement of the pop-up sprinkler head 70 without hiring a contractor; a reduction of labor time (cost) of approximately seventy-five percent (75%) should a contractor be hired; easy verification of sprinkler performance and water leaks; extension of the useful lift of the pop-up sprinkler head 70 as they are not in direct contact with grade 75; protection of the pop-up sprinkler head 70 from contact with overgrown roots, plants, lawn mower, sun, weathering, and the like, and protection of any adjacent vegetation 80 every time a pop-up sprinkler head 70 requires access by elimination of excavation.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An underground sprinkler head access housing and a sprinkler assembly, comprising:

a base having a flange and a plurality of stiffening members;

a plurality of spacers placed above the base;

a sprinkler lateral, a tee fitting, and a riser pipe extended upward and terminating at a pop-up sprinkler head;

a plurality of access holes provided for enhance and exit of the sprinkler lateral, the sprinkler lateral enters and exits through the access holes in the base above the flange, the sprinkler lateral is interconnected at the tee fitting with the riser pipe, the pop-up sprinkler head is held in position by a plurality of support arms, each of the support arms include a stationary support, a movable support, an adjustment mechanism and a holding jaw;

a sprinkler head support assembly providing vertical stabilization for the pop-up sprinkler head, the sprinkler head support assembly is located above an uppermost spacer;

a cap disposed on top of the spacers; and a flapper assembly located at a center of the cap to allow access to the popup sprinkler head in an activated position;

wherein the adjustment mechanism is an adjustment knob to place the holding jaw in a disengaged position;

wherein the adjustment knob is manipulated to place the holding jaw in an engaged position as part of an installation process;

wherein a lower convex surface of the sprinkler head support assembly is capable of mating with a concave surface of the base;

wherein a lower convex surface of one of the spacers will mate with the concave surface of the base in one configuration;

wherein the lower convex surface of one of the spacers is also capable of mating with a concave surface of another one of the spacers in a different configuration;

wherein the cap is provided with a threaded connector which engages the cap to the sprinkler head support assembly;

wherein the popup sprinkler head is removed by rotating it along a removal travel path to the pop-up sprinkler head for maintenance, repair, or replacement;

wherein the popup sprinkler head is reapplied by rotating it along an installation travel path;

wherein the spacers are added such that the cap and the flapper assembly are above grade; and wherein the access holes allow for installation and subsequent use of the underground sprinkler head access housing in existing sprinkler installations as part of a retrofit process.

2. The underground sprinkler head access housing and the sprinkler assembly according to claim 1, wherein the spacers are cylindrical in shape.

3. The underground sprinkler head access housing and the sprinkler assembly according to claim 1, wherein the movable support is inserted into the stationary support and moves in and out along a travel path which forces the holding jaw against the pop-up sprinkler head.

4. The underground sprinkler head access housing and the sprinkler assembly according to claim 3, wherein movement of the movable support is accomplished by the adjustment mechanism acting upon a threaded surface.

5. The underground sprinkler head access housing and the sprinkler assembly according to claim 1, wherein the cap is provided with an anti-slip surface for increased safety.

* * * * *